US006561505B2

(12) United States Patent
Takaki et al.

(10) Patent No.: US 6,561,505 B2
(45) Date of Patent: May 13, 2003

(54) PAPER FEEDING APPARATUS

(75) Inventors: Kosuke Takaki, Kasuga (JP); Yoshihiro Itoh, Onojo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/947,407

(22) Filed: Sep. 7, 2001

(65) Prior Publication Data

US 2002/0060390 A1 May 23, 2002

(30) Foreign Application Priority Data

Sep. 8, 2000 (JP) ..... 2000-272826

(51) Int. Cl.[7] ..... B65H 5/00

(52) U.S. Cl. ..... 271/10.12; 271/162; 271/127; 271/279

(58) Field of Search ..... 271/4.1, 9.09, 271/10.12, 117, 127, 162, 241, 279, 303

(56) References Cited

U.S. PATENT DOCUMENTS 4,998,216 A * 3/1991 Hino et al. ..... 271/9.09
5,154,408 A * 10/1992 Stepan et al. ..... 271/176
5,171,125 A * 12/1992 Kleinhen ..... 271/121
5,228,673 A * 7/1993 Osonoe ..... 271/10.01
5,253,015 A * 10/1993 Morita et al. ..... 271/121
5,573,235 A * 11/1996 Asai ..... 271/121
5,715,071 A * 2/1998 Takashimizu et al. ..... 271/166
5,722,654 A * 3/1998 Sootome et al. ..... 271/127
5,743,518 A * 4/1998 Takashimizu et al. ..... 271/117
5,956,161 A * 9/1999 Takashimizu et al. ..... 358/496
6,131,899 A * 10/2000 Nojima et al. ..... 271/116

FOREIGN PATENT DOCUMENTS

JP 06080255 A * 3/1994 ..... B65H/1/26

* cited by examiner

*Primary Examiner*—Donald P. Walsh
(74) *Attorney, Agent, or Firm*—Stevens, Davis, Miller & Mosher, LLP

(57) ABSTRACT

In order to provide a paper feeding apparatus which is miniaturized by inclining a conveying passage and can quickly feed a manuscript even if the manuscript is thick, there is provided a paper feeding apparatus in which a conveying passage for a manuscripts is formed so as to continuously connected with a hopper on which the manuscripts are placed, and the manuscripts placed on the hopper are picked up one by one from an uppermost one thereof and fed to the conveying passage, wherein the conveying passage is inclined in the height direction so that the hopper side thereof is downward, and the angle of the hopper can be set so as to be arranged in a straight line in accordance with the inclination of the conveying passage.

8 Claims, 3 Drawing Sheets

PAPER FEEDING APPARATUS

BACKGROUND OF THE INVENTION

The present invention relates to a paper feeding apparatus used in an apparatus such as a manuscript moving type image scanner, and more particularly to a paper feeding apparatus which can stably feed a manuscript paper even if the paper is thick.

Conventionally, there has been widely used an image scanner in which a manuscript paper is fed and an image thereon is read and computerized. In this image scanner, the manuscript papers are placed on a hopper and fed one by one to a paper conveying passage by means of a paper feeding roller, and then the image on the paper is read by an image reader provided on the paper conveying passage.

FIG. 3 is a schematic view of the conveying structure for a manuscript paper in a conventional image scanner, in which manuscript papers P are placed on a hopper 51 and a paper feeding roller 52 is disposed above the hopper 51 so as to contact with the uppermost manuscript paper P. On the downstream side of the paper feeding roller 52, there are disposed a separating roller 53 for preventing overlapped feeding of the manuscript papers P, and a retard roller 54 with a torque limiter therein. Further, on the downstream side of those, a plurality of pairs of conveying rollers 55*a* and 55*b* are disposed for nipping and conveying the manuscript paper P. In the middle of a conveying passage provided with the conveying rollers 55*a* and 55*b*, image reader 56 and 57 are disposed for optically reading a manuscript image on the manuscript paper P.

BRIEF SUMMARY OF THE INVENTION

In the case of the paper feeding structure shown in FIG. 3, the manuscript paper P on the hopper 51 and the conveying passage are arranged substantially on a straight line, and the conveying passage including the conveying rollers 55*a* and 55*b* is horizontally arranged, so that the length of the conveying passage in the right and left direction (horizontal direction) in the drawing is long. Thus, the total length of the apparatus also becomes long, and the miniaturization of the apparatus is limited.

Accordingly, by inclining the conveying passage so that the left end side thereof tends upward, the plane length of the conveying passage becomes short, so that the apparatus is miniaturized, and besides, it is possible to install equipment such as a power source in the space under the conveying passage, so that the design flexibility is improved.

In the case that the conveying passage is inclined, however, a bending portion is formed in the paper feeding passage between the paper feeding roller 52 on the manuscript paper P placed on the hopper 51, and the separating roller 53 and retard roller 54 provided on the downstream side of the paper feeding roller 52. In this case, although thin paper can pass thorough the bending portion without trouble since it follows the bend, thick paper may not pass along the bend, that is, the paper may not be fed. Accordingly, in an image scanner for reading a manuscript image on various kinds of manuscript papers, it is impossible to read an image on the thick paper if the conveying passage is inclined for the miniaturization of the apparatus.

Accordingly, it is an object of the present invention to provide a paper feeding apparatus which is miniaturized by inclining a conveying passage and can feed a manuscript paper quickly, even if the paper is thick.

According to the invention, there is provided a paper feeding apparatus comprising a hopper for holding a sheet thereon, a conveying passage connected with the hopper, and a feeding device for feeding the sheet from the hopper to the conveying passage, wherein the conveying passage is inclined in the height direction so that the hopper side thereof is downward.

Preferably, the hopper is inclined in the height direction so that the hopper is substantially aligned with the conveying passage. Alternately, the inclination angle of the hopper may be variable between the horizontal angle and an angle at which the hopper is substantially aligned with the conveying passage.

The apparatus may further comprise a first passage branching upward from the upper end of the conveying passage, a second passage extending straight from the upper end of the conveying passage at the same inclination angle, and a switching device provided at the branch point for switching the passages.

The hopper may hold a plurality of sheets thereon, and the feeding device may comprise a feeding roller pressed on the uppermost one of the sheets for feeding the sheet one by one from the hopper to the conveying passage.

According to the present invention, since the conveying passage is inclined, the plane length of the apparatus can be shortened. Further, since the inclination angle of the hopper can be varied in correspondence with that of the conveying passage so that the sheet conveying direction becomes straight, the apparatus can quickly feed the sheet even if the sheet is a thick manuscript.

A preferred embodiment of the present invention will be described below with reference to the accompanying drawings.

DETAILED DESCRIPTION OF THE INVENTION

Figure 1:
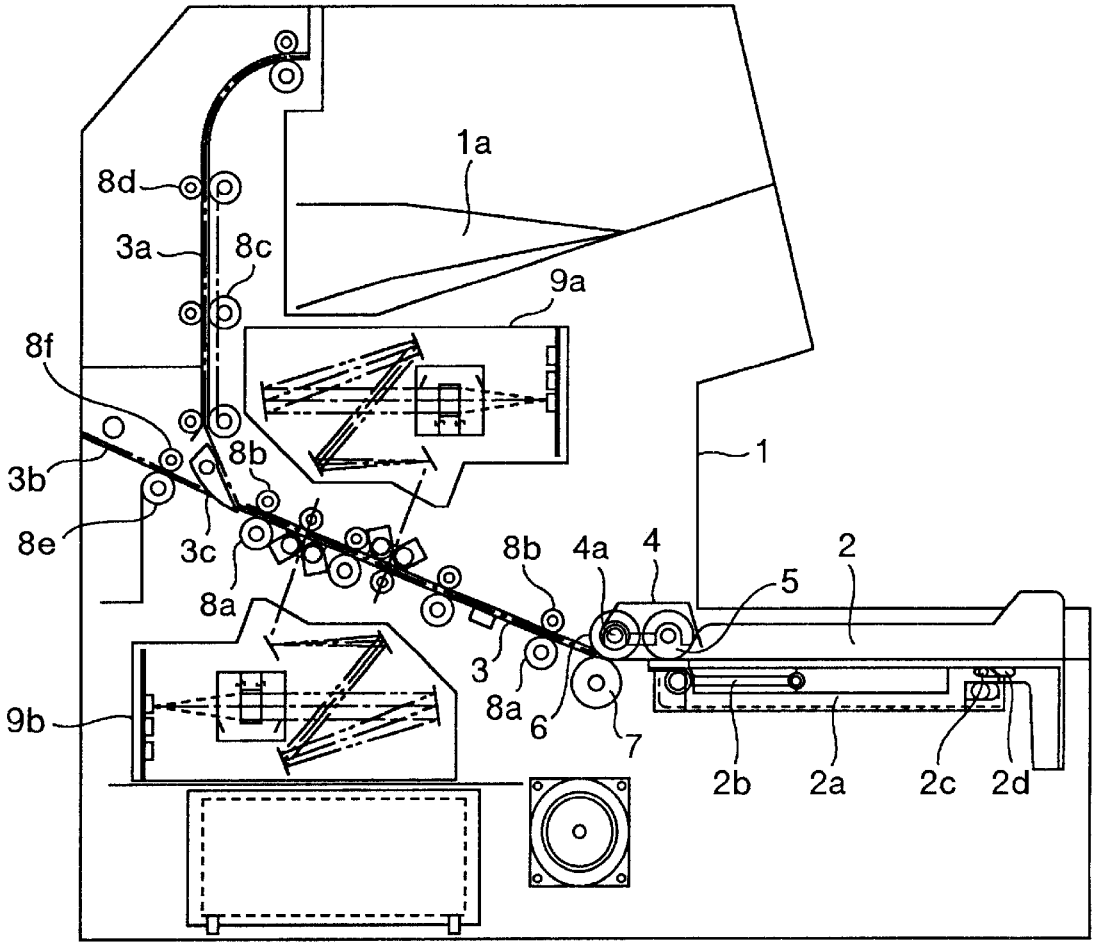
FIG. 1 shows a schematic view of the internal structure of an image scanner with a paper feeding apparatus according to the present invention.
Figure 2:
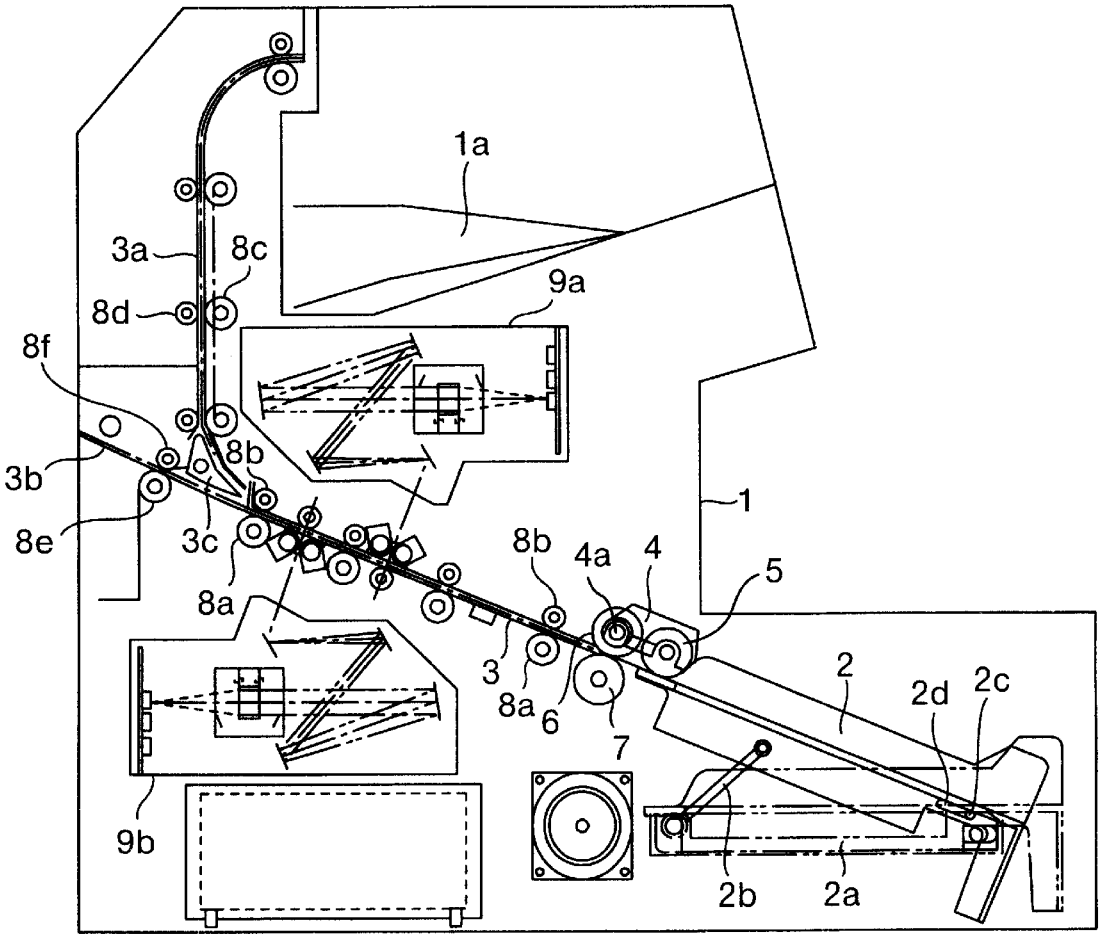
FIG. 2 shows a schematic view of the image scanner at the time when a hopper is set in a state of alignment with a conveying passage so as to be adapted to a thick manuscript.
Figure 3:
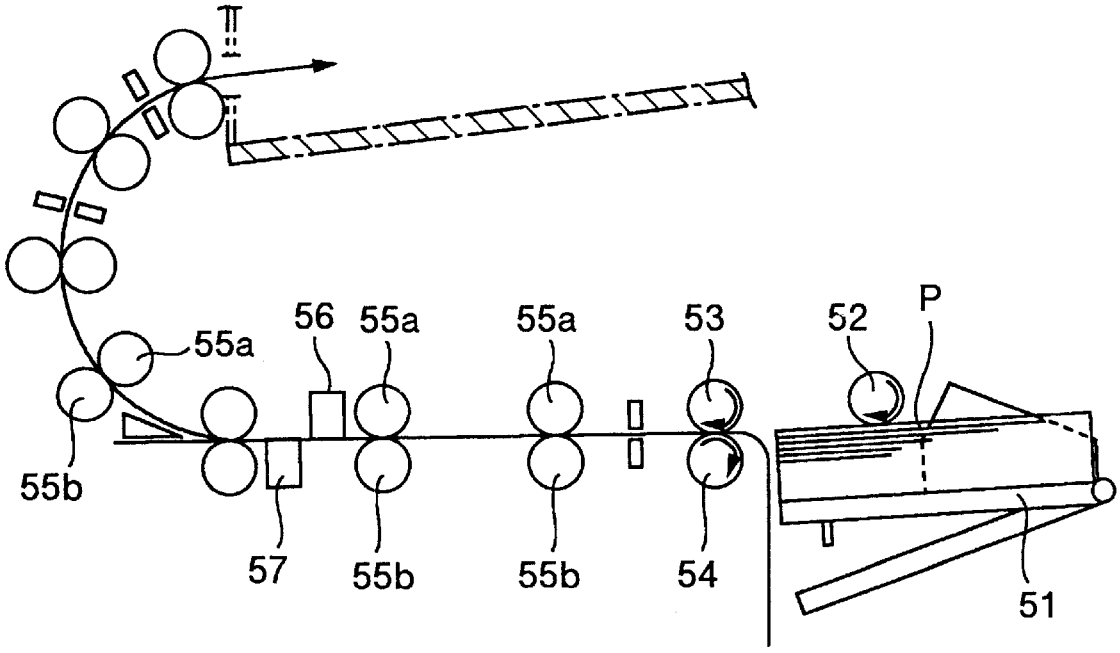
FIG. 3 shows a schematic view of the conveying structure of a manuscript paper in a conventional image scanner.

FIG. 1 shows a schematic view of the internal structure of an image scanner with a paper feeding apparatus of the present invention, and FIG. 2 shows a schematic view at the time when a hopper is set in a state of alignment with a conveying passage so as to be adapted to a thick manuscript.

In FIG. 1, a hopper 2 is installed in a main body 1 of the image scanner at its right end side. This hopper 2 is mounted on a hopper chassis 2*a* which is provided so as to be capable of being driven to move up and down in the vertical direction in the main body 1, by means of a link rod 2*b* which is attached to the hopper chassis 2*a* so as to be capable of rising and falling and a pin 2*c* provided on the right end side thereof. The pin 2*c* is slidably inserted into a horizontally elongated hole 2*d* provided in the hopper 2.

On the left end side of the hopper 2, a conveying passage 3 for a manuscript paper is arranged continuously. This conveying passage 3 is composed by arranging two plates with a vertical space, and the manuscript paper is conveyed to pass through therebetween. As shown in the drawing, the conveying passage 3 is inclined so that the left side thereof is upward, and branched in two directions of a first branch passage 3*a* for carrying a thin manuscript paper and a second branch passage 3*b* for carrying a thick manuscript paper at the terminating side thereof, and a switching lever 3*c* is disposed at the branch point. The first branch passage 3*a* is composed to rise from the terminal end of the conveying passage 3, and the upper end portion is bent to the right side to guide the manuscript paper toward the recovery tray 1*a* on the upper surface of the main body 1. Contrary, the second branch passage 3*b* is formed on the extension line of the conveying passage 3, so that the conveying passage 3 and the second branch passage 3*b* are aligned in a straight line.

At the base end part of the conveying passage 3, a paper feeding roller 5 and a separating roller 6 which are integrally held by a frame 4, and a retard roller 7 are arranged. The frame 4 can freely turn up and down around a spindle 4*a* connected to the main body 1, so that the paper feeding roller 5 comes into contact with the manuscript paper by the self-weight of the frame 4 and the paper feeding roller 5 to perform the paper feeding. When the paper feeding roller 5 is not contacting with the manuscript paper, the frame 4 is supported by a stopper which is not shown in the drawing. The paper feeding roller 5, the separating roller 6, and the retard roller 7 are rotationally driven by a common driving mechanism (not shown), and the paper feeding roller 5 is arranged to come into contact with the uppermost paper of the manuscript papers placed on the hopper 2. The paper feeding roller 5 and the separating roller 6 are rotationally driven in the direction such that the manuscript paper is fed out, that is, in the clockwise direction in the drawing. On the other hand, the retard roller 7 provided with a torque limiter therein is a conventionally well known roller which prevents the overlap feeding of the paper by usually rotating in the reverse direction of the paper feeding direction.

On the downstream side of the frame 4, a pair of conveying rollers 8*a* and 8*b* are arranged along the conveying passage 3. Similarly, a pair of conveying rollers 8*c* and 8*d* are provided in the first branch passage 3*a*, and a pair of conveying rollers 8*e* and 8*f* are also arranged in the second branch passage 3*b*. Furthermore, optical reading devices 9*a* and 9*b* for reading the manuscript pictures on the upper surface and lower surface of the manuscript paper respectively are arranged across the conveying passage 3 vertically.

In the above described structure, since the conveying passage 3 is obliquely inclined, the size of the main body 1 becomes short in the left and right direction and thus the main body 1 is miniaturized in comparison with a conventional one in which a conveying passage is horizontally arranged. Further, since an open space is formed under the conveying passage 3, it is possible to dispose a device in the space and thus the flexibility of designing can also be improved.

When a thin manuscript paper is processed, the hopper chassis 2*a* is raised as shown in FIG. 1, so that the uppermost paper of the manuscript papers placed on this hopper 2 is brought into contact with the paper feeding roller 5. Further, the switching lever 3*c* is set to a position so as to guide the manuscript paper to the first branch passage 3*a* side from the conveying passage 3, as shown in the drawing. When commanding the reading action, the paper feeding roller 5, the separating roller 6, and the retard roller 7 are rotationally driven respectively, and the conveying rollers 8*a*, 8*b*, 8*c* and 8*d* are also similarly rotationally driven. Accordingly, the paper feeding roller 5 picks up a sheet of manuscript paper placed on the hopper 2 and feeds it to the conveying passage 3, and the manuscript picture on the manuscript paper is read by the optical reading devices 9*a* and 9*b*. Then, the manuscript paper is advanced in the first branch passage 3*a* and discharged on the recovery tray 1*a*. Although the mounted number of the manuscript papers is reduced and thus the bulk becomes low as the manuscript papers placed on the hopper 2 are fed one by one, the height of the hoppers 2 is controlled so that the height of the manuscript paper at the uppermost layer to be fed is kept approximately in a level by raising the hopper.

On the other hand, in the case that the manuscript paper placed on the hopper 2 is thick, the right end side of the hopper 2 is inclined downward, and the attitude thereof is set so that the manuscript paper placed on the hopper 2 is arranged in a straight line with respect to the conveying passage 3, as shown in FIG. 2. The setting of the hopper 2 into such the attitude is performed by falling the hopper chassis 2*a* from the state in FIG. 1 and raising the hopper 2 by hand, as shown in the drawing. The pin 2*c* relatively moves to the right side in the elongated hole 2*d*, and the link rod 2*b* rises up to the diagonal attitude and is locked at the attitude shown in the drawing. Then, at the same time when setting the hopper 2 into such the diagonal attitude, the frame 4 also inclines so that the right side is downward. Further, it is also possible that the setting of the hopper 2 into the diagonal attitude and the recovery action to the horizontal attitude in FIG. 1 may be performed by using an automatic system where the link rod 2*b* is rotationally driven by a motor or the like.

According to the above described setting, the hopper 2 is supported in an attitude where it is inclined at the same angle as the conveying passage 3, and the paper feeding roller 5 and the separating roller 6 also change the attitude so that they are arranged along a straight line extending from the hopper 2 toward the conveying passage 3. The conveying rollers 8*a* and 8*b* of the conveying passage 3 and the conveying rollers 8*e* and 8*f* of the second branch passage 3*b* are rotationally driven, and the switching lever 3*c* is set to the attitude of opening to the second branch passage 3*b*.

Accordingly, by inclining the hopper 2 to be arranged in a straight line with the conveying passage 3, the path of the manuscript paper from the hopper 2 to the second branch passage 3*b* can be made in a straight line. Thus, even if the manuscript paper is thick, it can be sent out on a straight line by the paper feeding roller 5, and the paper feeding is quickly performed, so that it is possible to feed a paper without causing any paper jam.

According to the present invention, since the conveying passage is inclined in the height direction in the main body of the apparatus, it is possible to shorten the length of the main body and utilize the space under the conveying passage for the installation place of a device, so that the flexibility of the design is improved. Further, since the hopper and the conveying passage can be continuously connected in a straight line, it is possible to quickly feed a manuscript without bending the manuscript forcibly even if the manuscript is thick.

What is claimed is:

1. A paper feeding apparatus comprising:

a hopper for holding a sheet thereon;

a conveying passage connected with the hopper and for extending from the hopper toward a sheet discharge port of the apparatus; and a feeding device for feeding the sheet from the hopper to the conveying passage, wherein:

the conveying passage is inclined in a longitudinal direction thereof so that the hopper side thereof is lower than a side thereof closer to said discharge port; and the hopper is inclined to cause said sheet held thereon to be substantially aligned with the conveying passage in a straight line.

2. A paper feeding apparatus according to claim 1, wherein the hopper holds a plurality of sheets thereon, and the feeding device comprises a feeding roller for pressing on an uppermost one of the sheets for feeding the sheets one by one from the hopper to the conveying passage.

3. A paper feeding apparatus according to claim 1, further comprising a first branch passage which branches upward from said side of the conveying passage closer to said discharge port, and a switching device provided at a branch point for switching the passages.

4. A paper feeding apparatus according to claim 3, further comprising a second branch passage which extends from said side of the conveying passage closer to said discharge port and is at the same inclination angle as said conveying passage.

5. A paper feeding apparatus comprising:

a hopper for holding a sheet thereon;

a conveying passage connected with the hopper and for extending from the hopper toward a sheet discharge port of the apparatus; and a feeding device for feeding the sheet from the hopper to the conveying passage, wherein:

the conveying passage is inclined in a longitudinal direction thereof so that the hopper side thereof is lower than a side thereof closer to said discharge port; and an inclination angle of the hopper is variable between a horizontal angle and an angle at which the sheet held on the hopper is substantially aligned with the inclined conveying passage in a straight line.

6. A paper feeding apparatus according to claim 5, wherein the hopper holds a plurality of sheets thereon, and the feeding device comprises a feeding roller for pressing on an uppermost one of the sheets for feeding the sheets one by one from the hopper to the conveying passage.

7. A paper feeding apparatus according to claim 5, comprising a first branch passage which branches upward from said side of the conveying passage closer to said discharge port, and a switching device provided at a branch point for switching the passages.

8. A paper feeding apparatus according to claim 7, further comprising a second branch passage which extends from said side of the conveying passage closer to said discharge port and is at the same inclination angle as said conveying passage.

* * * * *